United States Patent [19]

Kovar

[11] 3,981,384

[45] Sept. 21, 1976

[54] COIN SIZE TESTER

[75] Inventor: Henry Charles Kovar, Anoka, Minn.

[73] Assignee: The Cornelius Company, St. Louis Park, Minn.

[22] Filed: Dec. 5, 1975

[21] Appl. No.: 638,026

[52] U.S. Cl. ..... 194/102; 133/3 R

[51] Int. Cl.[2] ..... G07F 3/02

[58] Field of Search ..... 194/97 R, 102; 133/3 R, 133/3 E; 209/82, 83; 73/163

[56] References Cited

UNITED STATES PATENTS

| | | | |
|---|---|---|---|
| 969,914 | 9/1910 | Spindler | 194/102 |
| 1,503,223 | 7/1924 | Bee | 133/3 R |
| 3,768,618 | 10/1973 | Collins | 194/102 |

FOREIGN PATENTS OR APPLICATIONS

| | | | |
|---|---|---|---|
| 642,269 | 2/1937 | Germany | 194/102 |
| 523,067 | 3/1931 | Germany | 194/102 |

*Primary Examiner*—Robert B. Reeves
*Assistant Examiner*—Joseph J. Rolla

[57] ABSTRACT

A coin tester for testing the diameter of coins is disclosed and has a trackway for coins to roll through, a journal positioned lateral to the trackway, and a ball in the journal which ball projects into the trackway and is moveable in the journal by a properly sized coin for passage of the coin; if the coin is of less than proper size, the ball will force the coin out of the trackway; also disclosed are double and triple trackway configurations.

49 Claims, 7 Drawing Figures

VII
VI
V
53
89
65
90
91
85
73
96
59
94
95
50
58
54
51

83
81
80
62
79
55
63
56
57
64
66
67
68
70
94
95
88
60
61
76
78
77
75
96

53
77
76
51
69
71
66
52
67
51
IV
54
50
70
59
60
61
96
65
93
92

COIN SIZE TESTER

BACKGROUND OF THE INVENTION

1. Field of the Invention

This invention pertains to a coin tester which tests the size of a coin.

2. Prior Art

The prior art devices include a cradle having a pair of spaced apart fingers for catching a coin of proper diameter and passing a coin of less than proper diameter; after the cradle catches the proper coin, it usually rotates and then drops the coin into a trackway. Another prior art device has a spaced apart upper and lower edge with an aperture between the edges and a spring loaded finger to force any coin of less than proper diameter through the aperture for rejection. The prior art devices are characterized by having either some type of bearing construction for rotation which has a friction of variable and changeable value or a spring loaded device subject to the normal variances of physical properties of springs. Further, it is well known that the prior art is reasonably expensive, very susceptible to dirt and foreign matter and usually requiring of periodic adjustment by a skilled serviceman.

SUMMARY OF THE INVENTION

In accordance with this invention, a coin tester is provided having a trackway with a bottom surface upon which a coin may roll, a guide to hold a coin upright on the bottom surface, retainer and sizer edges, and a journal which is positioned laterally to the trackway and has therein a ball which normally projects into the trackway and is moveable in the journal by a properly sized coin for passage of the coin through the trackway and past the ball.

Accordingly, it is an object of the present invention to provide a coin tester using a ball for testing of the coin.

It is an object of the present invention to provide a coin tester that is virtually frictionless.

It is an object of the present invention to provide a coin tester that is extremely economical.

It is another object of the present invention to provide a coin tester that has constant and consistent testing characteristics.

It is yet another object of the present invention to provide a coin tester which, if it fails, will pass properly sized coins.

It is a further object of the present invention to provide a coin tester using balls for testing a plurality of coins.

It is an object of the present invention to provide a coin tester of an economical configuration having balls for testing of a plurality of different sized coins.

Many other advantages, features and additional objects of the present invention will become manifest to those versed in the art upon making reference to the detailed description and the accompanying sheets of drawings in which preferred structural embodiments incorporating the principles of the present invention are shown by way of illustrative example.

IN THE DRAWINGS

AS SHOWN IN THE DRAWINGS

Figure 1:
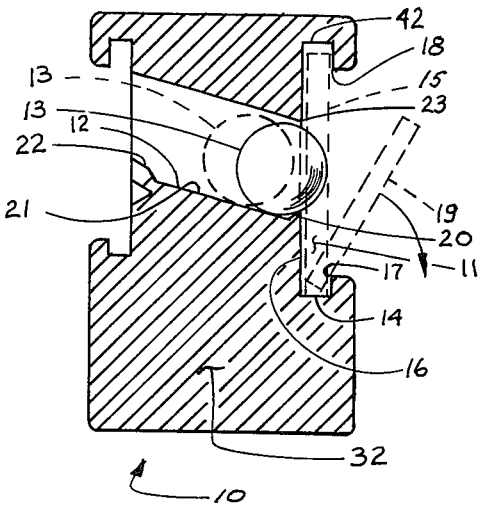
FIG. 1 is an elevational end view in section of a coin tester provided in accordance with the principles of the present invention.

The principles of the present invention are particularly useful when embodied in a coin tester of the type illustrated in FIG. 1 and generally indicated by the numeral 10. The coin tester 10 includes a coin trackway 11, a journal 12 and a ball 13 within the journal 12.

The coin trackway 11 of the coin tester 10 has a bottom surface 14 upon which a coin 15 may roll on edge. On one side of bottom surface 14 there is provided a guide 16 for holding the coin 15 upright. On the other side of the bottom surface there is a retainer edge 17 which extends upward for engaging and maintaining the rim of the coin 15 on the bottom surface 14. At the upper extremity of the trackway 11 there is a sizer edge 18 which is spaced outward from the guide 16, as is the retainer edge 17 to form and define a width of the trackway 11 adequate for the coin 15. The sizer edge 18 is directly above the retainer edge 17; the opening between the retainer edge 17 and sizer edge 18 is for an undersize coin 19 to fall out through. The sizer edge 18 is precisely spaced from the bottom surface 14 to retain in the trackway 11 only a coin of at least a predetermined size. For example, a nickel is 0.836 inches (21.2 mm) in diameter and a very commonplace slug is 13/16 inches (20.7 mm) diameter. The spacing between the bottom surface 14 and sizer edge 18 can be precisely spaced at about 0.816 inches (20.7 mm) for engaging and retaining only a nickel upright on the bottom surface 14 in trackway 11.

The journal 12 is positioned in the coin tester 10 laterally to the length of the trackway 11 and contains the ball 13. The journal 12 has a support 20 for positioning the ball 13, a ramp 21 upon which the ball 13 may roll up and down and a keeper 22 which retains the ball 13 in the journal 12. The support 20 is positioned to support and position the ball 13 in a normal position where the ball 13 projects into the trackway 11. The support 20 also serves together with an upper edge 23 of the journal 12 to keep the ball 13 within the journal 12 so it cannot fall out. The ramp 21 is an elongate surface extending laterally from the length of the trackway and preferably is perpendicular to the length of the trackway 11. The ramp 21 extends upwardly from the support 20 and to the outside or backside of the guide 16 at an angle in the range of 10 to 35 degrees above horizontal. The ball 13 is free to roll up and down on the ramp 21 and the upward angle biases the ball 13 downward and outward against the support 20 and into the trackway 11 due to the force of gravity acting upon the ball 13. At the upper end of the journal 12, there is a keeper 22 which partially closes the journal 12 and contains the ball 13 within the journal 12.

The ball 13 is free within the journal 12 and is contained by the support 20 and the keeper 22. The ball is positioned to project into the trackway 11 the width of the trackway 11 as defined by the space between the guide 16 and the retainer and sizer edges 17, 18. The ball 13 preferably has a diameter greater than twice the width of the trackway 11 and the ball 13 projects into the trackway 11 in the range of 20 to 45 percent of its diameter. The full diameter of the ball 13 is behind the guide 16 so that it can be engaged and held by the journal 12. An ideal ball 13 has been found to be a metal bearing ball of stainless steel having a diameter of 0.312 inches (8 mm). As is clearly shown, the ball 13 projects into the trackway 11 at a level between the retainer and sizer edges 17, 18. The journal 12 has a larger cross-section than the ball 13 which is thereby free to roll up and down the ramp 21 as will be described.

Figure 2:
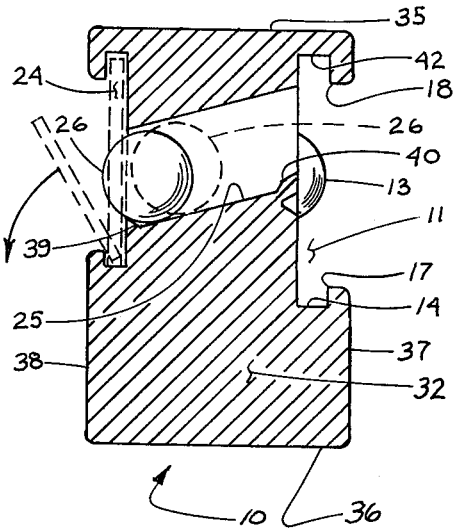
FIG. 2 is a further elevational end view in section of the structure of FIG. 1.

The view of FIG. 2 shows a second coin trackway 24, journal 25 and ball 26 in the coin tester 10 which are identical to previously described components except that they face oppositely and the second trackway 24 is sized for a different coin such as a dime. When there are a pair of trackways 11, 24, they are positioned with their guide sides facing each other and the edged sides facing outward. The journals 12, 24 and the balls 13, 26 are positioned between the trackways 11, 24.

Figure 3:
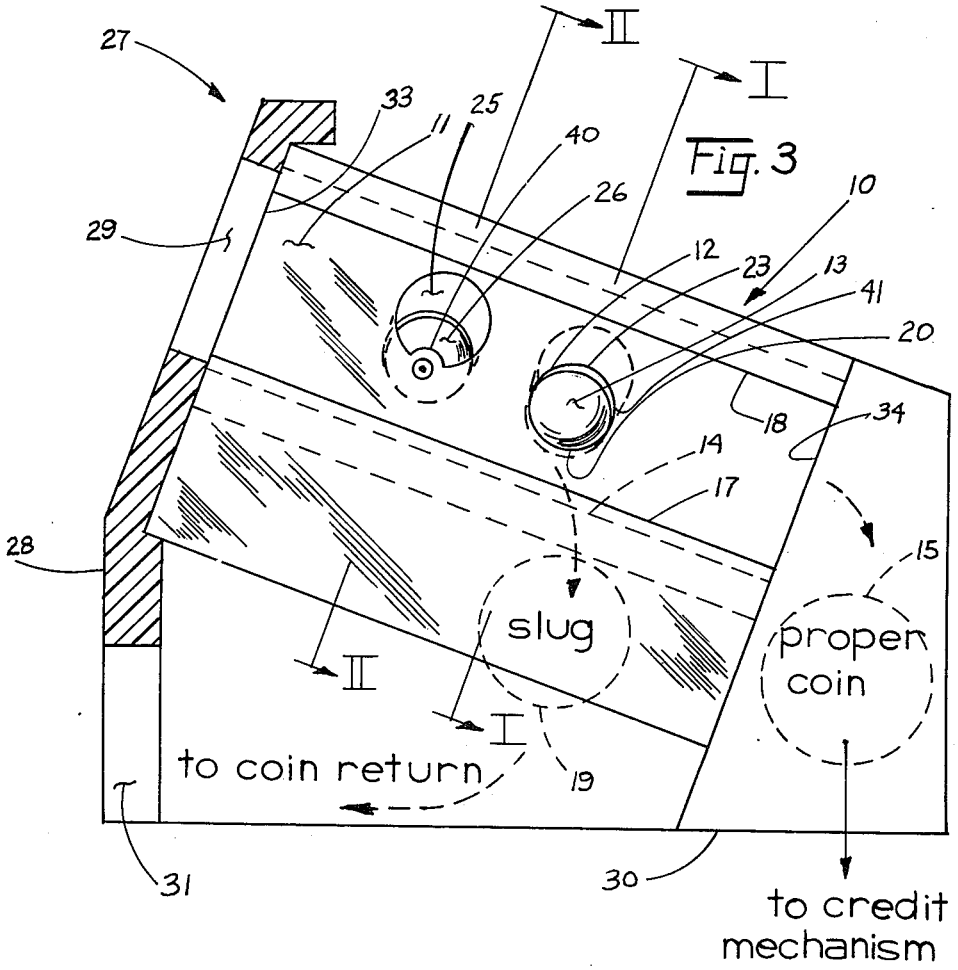
FIG. 3 is an elevational side view of the structure of FIG. 1 shown in a coin mechanism, sectional views FIG. 1 and FIG. 2 being taken along lines I—I and lines II—II respectively.

Referring to FIG. 3, the coin tester 10 is shown installed in a coin mechanism generally indicated by the numeral 27 which includes a cover 28 having a coin slot 29 for the trackway 11 and another coin slot (not shown) for trackway 24, a coin hopper 30 which together with the cover 28 holds the coin tester 10 in place, and a coin or slug return 31. Coin slot 29 is sized to prevent oversize slugs from being inserted into the coin tester 10. It has been found that the ball should be located in the coin tester 10 away from the coin slot 29 at least the diameter of the coin to be tested so that the coin is completely free of the coin slot when it makes contact with a ball. Shown in FIG. 3 is an arrangement whereby the necessary length of the coin tester 10 is minimized and the effectiveness is maximized. The journals 12, 25 and balls 13, 26 are spaced from each other, one being in front of the other. The journal and ball projecting into the trackway for the smaller diameter of the two different sized coins is nearest the coin slot or entry and the journal and ball for the larger diameter coin is the furthest from the coin entry slot. By this arrangement, the length of the coin tester 10 is minimized. The coin tester 10 may have a body 32 formed of an extrusion of either a light alloy or plastic and the journals 12, 25 may be machined into a section of extrusion cut to the proper length. An extremely economical configuration is shown wherein the journals 12, 25 are mirror images of one another. To be more specific, jounral 12 as well as ball 13 are the same distance from end 33 of extrusion body 32 as journal 25 and ball 26 are from end 34 of body 32. Each of the journals 12, 25 are a drilled bore of just slightly larger than the diameter of the ball and as the balls 13, 26 are of the same diameter, are physically identical and are interchangeable between journals 12, 25 so the journals 12, 25 may be of the same diameter. As shown in FIG. 2, each journal is at the same distance from one of the top 35 or bottom 36 surfaces of the body and at the same angle of inclination. Further, the depth of bored journal 12 with respect to the side 37 of body 32 is the same as the depth of bored journal 25 with respect to the other side 38 of body 32. It will be apparent that because trackway 24 is smaller than trackway 11, ball 26 will not project into trackway 24 as much as ball 13 projects into trackway 11. However, as the trackway 24 is narrower than trackway 11, the ball projection is still in the range of 20 to 45 percent of the ball diameter and the ball projection is still essentially the width of trackway 24. The significant advantage of the foregoing is that a single machining fixture and set-up can be used and the body 32 firstly machined on one side, then flipped and machined on the other side and both journals 12, 25 and support steps 20, 39 formed by the end of a drill, will be absolutely identical in physical size and feature. After a ball 13, 26 is placed in a journal 12, 25 from the access opening in the guide of the opposite trackway, part of the guide is deformed or peened in to form the keepers 22, 40.

In the operation of the structure shown in FIGS. 1-3, a coin 15 is placed in a coin slot 29 and if of proper size or smaller is passed from the coin slot 29 into the trackway 11 until free from the coin slot 29. The coin 15 rolls down upon the bottom surface 14, and is held on the bottom surface by guide 16 and retainer edge 17 and is held upright by the guide 16 and the sizer edge 18. As the coin 15 rolls, its inner edge makes angular contact with the ball 13 which tends to turn the coin 15 outward toward the retainer and sizer edges 17, 18 and providing the coin 15 is of at least the diameter of the spacing between the bottom surface 14 and the sizer edge 18, the coin 15 is held in the track and as it continues to roll in the trackway 11, the coin 15 drives the ball 13 against a backup cam surface 41 and up the ramp 21 against the force of gravity and the ball 13 retracts from the trackway 11 and allows the coin 15 to pass. After the coin 15 passes the ball 13, the ball 13 rolls back down the ramp 21 under the influence of gravity and returns to its normal position projecting into the trackway 11. The coin 15, after being tested for size by the ball 13 and the sizer edge 18, continues down the trackway 11, into a coin hopper 30 and to a credit mechanism (not shown) of any well known type.

In the event the coin 15 is an incorrect coin 19 of smaller size, for example a dime mistakenly placed in a nickel slot or a slug 19 of smaller than the predetermined coin size, the smaller coin 19 will not be of sufficient diameter to engage the sizer edge 18 and when the smaller coin 19 impacts against the ball 13, the ball 13 will turn the smaller coin 19 laterally out of the trackway 11 whereupon the smaller coin 19 will drop into a coin return 31.

In FIG. 3, the coin tester 10 is shown in a normal attitude having about 20 degree downslope. The coin tester 10 as previously described will work in virtually any attitude from horizontal to almost vertical provided that a coin 15 is somehow provided with either enough momentum to pass the ball 13 or else has a sufficient rolling force when contact is made with the ball 13 to be able to roll past the ball 13 without previously stored momentum. A downslope of the coin tester 10 to give the coin sufficient rolling force has been found preferable and in this respect it has been found that it is preferable to have the coin tester 10 and the trackway 11 sloping downwardly at an angle which is at least equal to and preferably greater than the angle at which the journal ramp 21 extends upwardly.

When the coin tester 10 and trackway 11 are almost vertical, it has been found that the bottom surface 14 tends to act as a size surface because the coin 15 may ride against the upper surface 42 of trackway 11 and it has been found advantageous to have the retainer edge 17 spaced from the upper surface 42 the same distance as is the sizer edge 18 spaced from the bottom surface 14. The foregoing, although described and explained particularly with respect to trackway 11 for a nickel, is applicable in entirety also to coin testers for dimes, quarters, half dollars, dollar coins and most foreign coins; the features just described, however must be sized for use with the intended coin.

Figure 4:
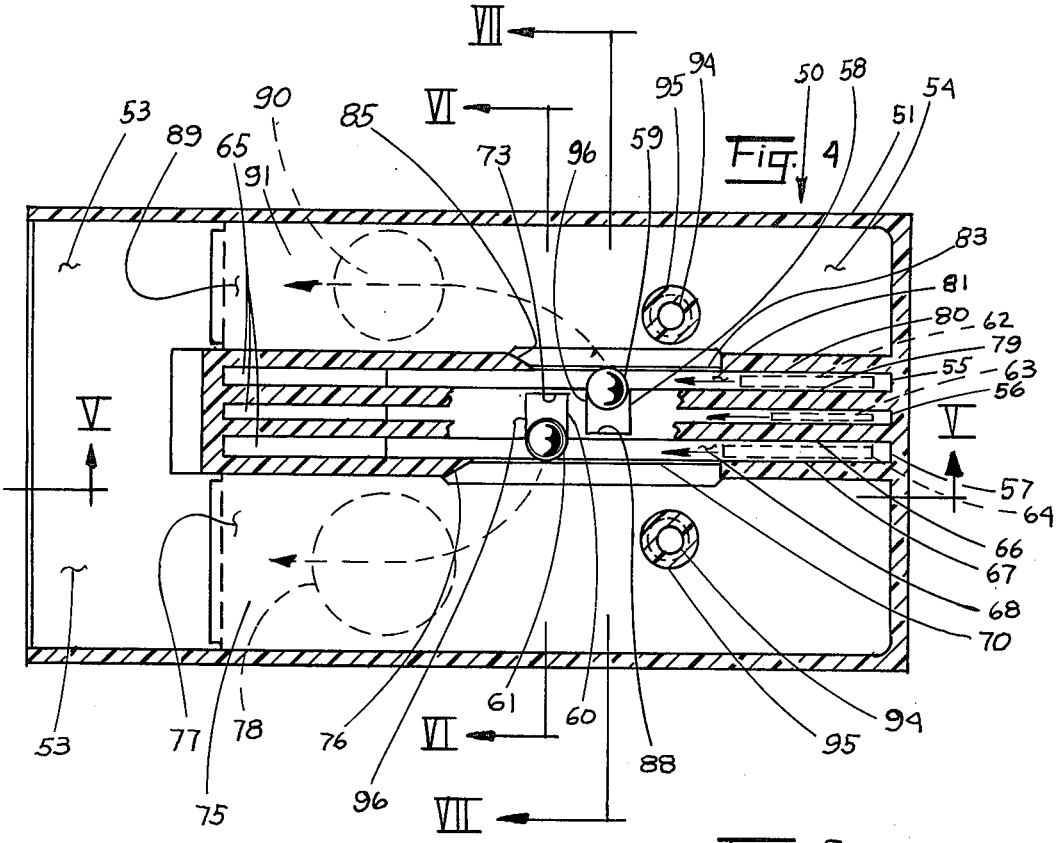
FIG. 4 is a sectional top view of another embodiment of the present invention.

Referring now to FIG. 4, there is shown another embodiment of the present invention in the form of a three or triple tracked coin tester generally indicated by the numeral 50. Coin tester 50 is essentially a complete module having a cover 51, three coin slots one of which is indicated by 52, and a coin return tray 53. The structural assembly of coin tester 50 is different from previously described coin tester 10 and includes a bottom plate 54 attached to the cover 51 and having several of the important features of the coin tester 50 thereon as will be explaind.

Coin tester 50 has three coin trackways; outside coin trackway 55 may be for nickels, central coin trackway 56 may be for dimes, and outside coin trackway 57 may be for quarters. Trackway 55 has a journal 58 and ball 59 for testing of coins and trackway 57 has a journal 60 and ball 61 for testing of coins. There is shown schematically in trackway 55 a coin 62 and directly above the coin 62 there is a coin slot (not shown) sized to permit entry of only the proper coin or a smaller sized coin or slug. There is shown schematically in trackway 56 a coin 63 and directly above coin 63 there would be a coin slot (not shown) sized to permit entry of only the proper coin or a smaller sized coin or slug. Shown schematically in trackway 57 is a coin 64 and directly above coin 64 there is a coin slot 52 (shown in FIG. 5) which is sized to permit entry of only the proper coin or a smaller coin or slug. At the end of each of the trackways 55, 56, 57 there is a coin drop slot 65 through which a properly sized and tested coin will pass to a credit mechansim (not shown) after the coin has passed through its respective trackway.

Figure 5:
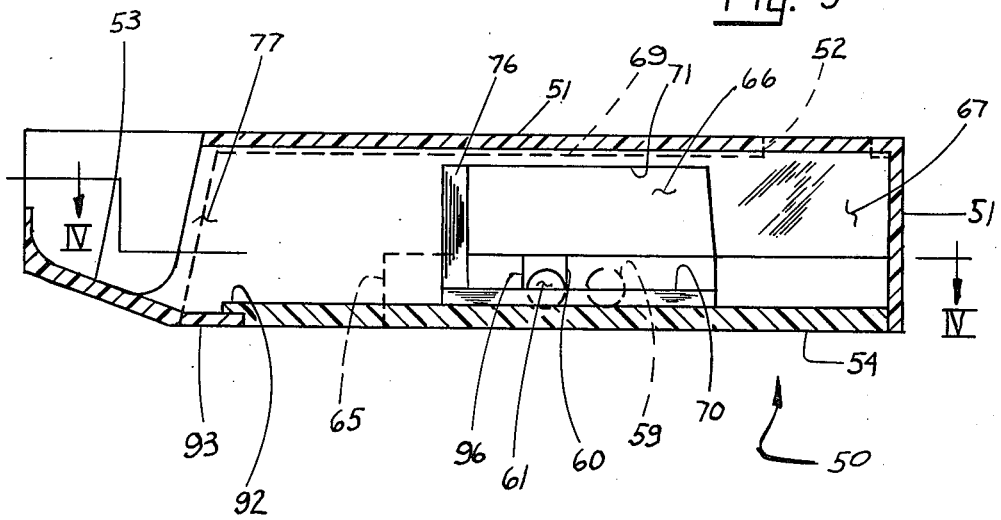
FIG. 5 is an elevational sectional view of the structure of FIG. 4 taken along lines V—V of FIG. 4, the view of FIG. 4 being taken along lines IV—IV of FIG. 5.
Figure 6:
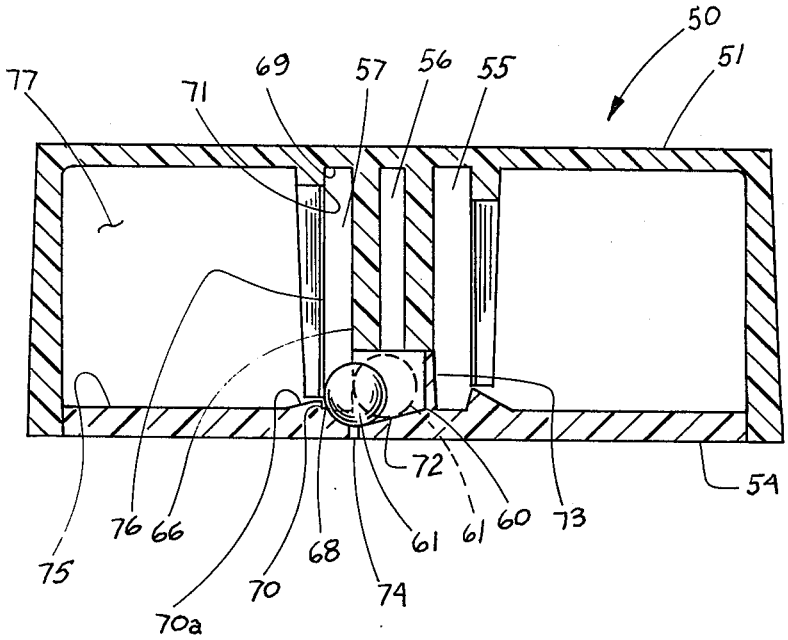
FIG. 6 is a sectional end view taken along lines VI—VI of FIG. 4.
Figure 7:
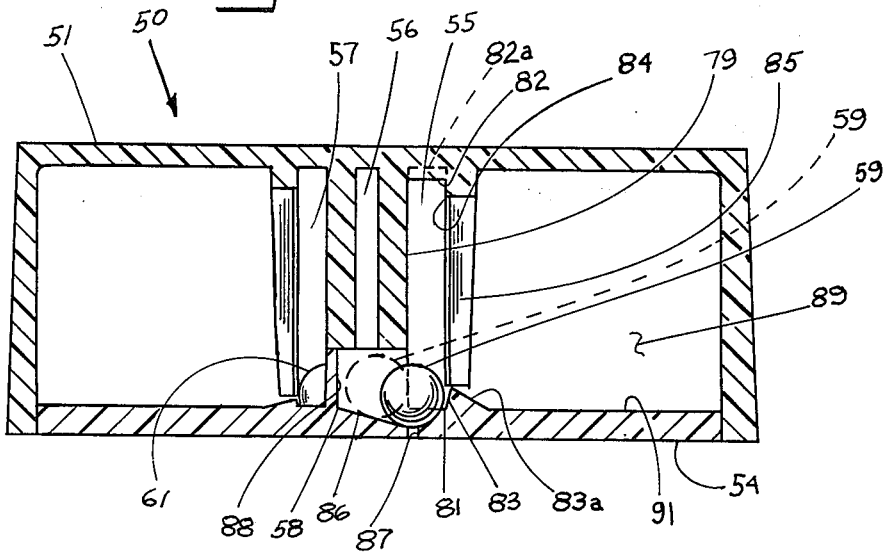
FIG. 7 is a sectional end view taken along lines VII—VII of FIG. 4.

Referring now to trackway 57 as shown in FIGS. 4, 5 and 6, and which in the United States is sized for testing and passing of a quarter. The trackway 57 includes a guide 66 running the length of the trackway 57 and a rib 67 spaced from the guide 66 and running downward from the coin slot 52 to a bottom surface 68. Progressing down the trackway 57 there is an upper surface 69 past the coin slot 52 and the rib 67 terminates and a retainer edge 70 and a sizing edge 71 begin and together with the guide 66 define the width of trackway 57. Positioned laterally and perpendicular to trackway 57 is journal 60 containing a ball 61. The journal 60 is positioned running through and behind the guide 66 and extends into and below the bottom surface 68 and has a lower concave spherical pocket with a greater radius than the ball 61. The interior surfaces of the journal 60 include an upwardly inclined ramp 72 inclined upward at an angle in the range of 10 to 35 degrees above horizontal and having a cross section with a concave rounded bottom having a radius greater than the radius of ball 61. At the upper end of the journal 60 there is a keeper 73 and at the lower end there is a drain 74 for condensate or foreign matter left in the journal 60 by coins. The ball 61 is positioned by the journal 60 to extend into trackway 57 virtually the entire width of trackway 57 and to be supported or retained in the trackway 57 by the retainer edge 70. The opening formed in the guide 66 by journal 60 is jointly restricted by the retainer edge 70 and the guide 66 so that the ball 61 cannot come out of the journal 60. The retainer edge 70 has an outer surface 70*a* sloped downward from the trackway 57 to a floor 75 at the outside of the trackway 57. In the trackway 57 the spacing between the bottom surface 68 and the upper surface 69 is sufficiently large to pass the proper coin, whatever it may be. In the case of a quarter in the U.S. and/or Canada, it has been found that a spacing of 0.990 inches (25.1 mm) is quite workable. The distance between the bottom surface 68 and the sizer edge 71 is precisely fixed to hold a proper coin upright in trackway 57 and to not hold upright any smaller coin or slug. In the example of a quarter, the distance between the bottom surface 68 and the sizer edge 71 is precisely spaced at 0.913 inches (23.2 mm). Also, the distance between the upper surface 69 and the retainer edge 70 is precisely spaced at the same 0.913 inches (23.2 mm) particularly at the location of the ball 61 because a coin may climb up and tend to go over the top of ball 61 when the ball 61 is in the bottom of the trackway 57. The spacing between the retainer edge 70 and upper surface 69 may be increased to either side of the ball 61 for additional clearance if needed. Further down in the trackway 57 there is a barrier 76 positioned vertically between the retainer edge 70 and the sizer edge 71, and preferably downward in the trackway about and preferably less than one half of the distance between the bottom surface 68 and the sizer edge 71 from the ball 61. The barrier 76 has at its front edge a surface tapered outward along the length of the trackway 57 as is best shown in FIG. 4. Further down from the barrier 76 there is a rejected coin opening 77 leading to the coin return tray 53 into which a rejected coin 78 may pass.

Referring now to trackway 55, which in the United States and/or Canada is the nickel trackway. Trackway 55 has a guide 79 extending the length of the trackway 55, a rim 80, a bottom surface 81, an upper surface 82, a retainer edge 83, a sizer edge 84 and a barrier 85. These components are all identical to those previously respectively described with respect to trackway 57. The nickel journal 58 and ball 59 are positioned laterally to the trackway 55 downward from the lower end of rim 80 at least the diameter of the coin to be tested and upward from the barrier 85 less than half the diameter of the coin to be tested. It will be appreciated that the dimension of the coin to be tested is approximately equal to and just marginally greater than the distance from the bottom surface 81 to the sizer edge 84. The nickel journal 58 and ball 59, being intended for a smaller coin than quarter journal 60 and ball 61, is positioned upward in the coin tester 50 nearer the coin entry slots in order to minimize the size of the coin tester 50; in this respect the journal 60 and ball 61 for the quarter are also located downward from the lower end of respective rim 67 at least the diameter of the quarter which it will be appreciated is larger than the diameter of a nickel. As the lower ends of ribs 67 and 80 are at the approximate same position along the lengths of respective trackways 57, 55, it will be seen that placement of the journal 58 and ball 59 for the smaller coin upward from the journal 60 and ball 61 for the larger coin definitely minimizes the necessary length of the trackways 57, 55. Journal 58 has a ramp 86, a drain 87 and a keeper 88 which are identical to the previously described features of journal 60, and the ball 59 is physically identical to ball 61. Downward of the barrier 85 there is a rejected coin opening 89 through which a rejected undersize coin 90 may pass into to coin return tray 53. In trackway 55, the distance between the bottom surface 81 and upper surface 82 is sufficiently large to pass a nickel and the distance or spacing between the bottom surface 81 and the sizer edge 84 is spaced precisely to size and hold upwardly only a coin of proper size; in the example of a nickel, a spacing of 0.816 inches (20.7 mm) has been found to work well with both U.S. and Canadian nickels. The distance or spacing between the upper surface 82 and the retainer edge 83 is also precisely spaced identically at 0.816 (20.7 mm) particularly in the immediate position of the journal 58 and ball 59 although at either end of this position the upper surface 82 may go higher for additional clearance as shown in dotted lines at 82*a*. The outer surface 83*a* of retainer edge 83 slopes downward and outwardly to a nickel reject floor 91 which extends to and through the reject opening 89.

Referring now to trackway 56 which is sized for the smallest coin to be used and which in the U.S. and Canada is the dime. Trackway 56 is positioned between the outer pair of trackways 55, 57 and more specifically is between the guides 66 and 79 which face inwardly toward each other. The trackway 56 extends over the top of the journals 58, 60, each of which is open to the trackway 56. When the coin tester 50 is in use, it is tipped upward about twenty degrees which gives a dime sufficinet rolling momentum to roll over the open journals 58, 60. By placing the journals 58, 60 and balls 59, 61 at the bottom of the larger trackways 55, 57 and then placing the smallest coin journal 56 atop of the journals 58, 60, the entire coin tester 50 is compacted into a structure having a height only as high as is needed for the largest coin.

The construction was previously explained as being of two parts with a separate cover 51 and bottom plate 54. Further describing the construction, which is extremely economical and easy to assemble, the bottom plate 54 has top flanges 92 which slide over bottom flanges 93 of cover 51 and hold the lower end of the bottom plate 54 to the cover. When the bottom plate 54 is separate, the balls 59, 61 are dropped into the journals 58, 60 and the top flanges 92 are slipped atop the bottom flanges 93 and the bottom plate 54 is turned upward until it is in place bearing against the cover 51. Then a pair of screws 94 are driven through the bottom plate into a pair of bosses 95 extending from the top of cover 51. After this assembly, the balls 59, 61 are retained in the journals 58, 60 jointly by the keepers 73, 88 and respective retainer edges 70, 83 and the bottom of the respective guides 66, 79 as carried by the cover 51. To inspect the finished assembly, the assembler merely shakes the coin tester 50 back and forth sideways and determines that both of the balls 59, 61 rattle inside of respective journals 58, 60.

In operation, the coin tester 50 is positioned with the trackways sloped downward about 20 degrees. Explaining the operation of the quarter trackway 57 first, a quarter 64 is dropped through slot 52 and onto bottom surface 68. The quarter 64 is held upright by the guide 66 and rib 67. The quarter 64 rolls down the trackway 57 on the bottom surface 68 and goes beyond the rib 67 whereupon it is held upright by guide 66 and sizer edge 71; the retainer edge 70 holds the quarter 64 upon the bottom surface 68. the quarter 64 makes contact with the ball 61, driving the ball downward against the ramp 72 and a cam surface 96 on the downward side of the journal 60; the ball 61 in turn drives the quarter out against the retainer edge 70 and sizer edge 71, which, providing that the quarter 64 is at least of proper diameter, hold the quarter 64 upright in the trackway. The quarter 64 continues down the trackway 57 and drives the ball 61 into the journal 60 and out of the trackway 57. The quarter 64 goes past the ball 61, goes down the trackway 57 and drops out of the coin drop slot 65 to be counted by a credit mechanism (not shown). After the quarter 64 passes, the ball 61 rolls back down the journal 60 from the retracted position shown in dotted lines to the normal position wherein it projects into the trackway 57. The return of the ball 61 is done entirely by gravity. However, were the quarter 64 a slug of less than proper size, or a nickel, penny or dime intentionally or accidentally placed in the quarter trackway 57, upon making contact with the ball 61, the incorrect coin 78 would be driven toward the retainer edge 70 and sizer edge 71 by the ball 61 and failing, because it is too small, to make contact with both edges 70, 71 the incorrect coin 78 would be driven out of the trackway 57, would slide down the outer slope 70*a* of the retainer edge 70, be scraped away from the trackway 57 by the barrier 76 and roll or slide down the floor 75, through the opening 77 to the coin return tray 53. Whether or not the incorrect coin is dropped by the sizer edge 71 or the retainer edge 70 or both will depend upon the weight and the size of the slug or coin. if the improper slug or coin 78 is heavy, it may be able to push the ball 61 into the journal 60 but the ball 61 will be able to push the upper edge of the coin 78 under the sizer edge 71 and out of the trackway 57 and when the coin 78 makes contact with the barrier 76 it will be directed out of the trackway 57. If the coin 78 is small and/or lightweight, it may ride up on the ball 61 in which event the lower edge of the coin 78 would be driven over the top of the retainer edge 70 onto the slope 70*a*. When this coin 78 makes contact with the barrier 76, it also will be directed from the trackway 57. The advantage of having the barrier 76 spaced downward from the ball 61 an amount about or less than half the coin diameter is that when the coin 78 is driven out bottom edge first, it tends to roll and turn back into the trackway 57 and each of the sloped surface 70*a* and the positioning of the barrier 76 help to keep the improper coin 78 from turning itself back into the trackway 57. As will be appreciated, if the improper coin 78 turns around the ball 61, the leading edge of the coin 78 will need more than half of the coin diameter in order to get back into the trackway 57. After the rejected coin 78 rolls or slides into the coin return tray 53, the exposed edge of the upper flange 92 helps to keep the coin 78 from bouncing back up onto the floor 75. The structure of trackway 57 and associated journal 60 and ball 61 is also ideally suited for being arranged with a vertical trackway 57 attitude. When in this attitude, the ball 61 will always bias a downwardly falling coin against the upper surface 69 and the lower edge of too small a coin will be driven outward over the top of retainer edge 70 and the too small coin will be rejected from the track. If the trackway 57 is in a vertical attitude, it will be appreciated that the journal 60 will still be sloped upwardly and still be generally lateral to the trackway 57.

The operation of the nickel trackway 55 is identical to the operation of the quarter trackway 57 except that the nickel trackway 55 faces the opposite direction and is sized to test and pass nickels 62 and to test and reject dimes and pennies and to drive and direct them to the coin return tray 53.

In the operation of the dime trackway 56, a dime 63 merely rolls down the trackway and over the open journals 58, 60 and out the drop slot 65 to be credited. All larger coins of lesser value, namely a penny and a nickel are precluded from entering the dime trackway 56 by a properly sized coin entry slot (not shown) in the top of cover 51 and as there are no smaller coins than a dime in circulation, a testing ball and journal are not needed.

The structure of the disclosed invention is extremely economical and reliable. There are only six parts in the complete coin tester 50, a molded plastic cover 51, a molded plastic bottom plate 54, a pair of identical, interchangeable commercial quality metal balls 59, 61, and a pair of screws 94. Assembly of the coin tester 50 is unparalleled for ease, consistency and economy. The operation of the coin tester 50, and coin tester 10 also relies only upon gravity, is virtually frictionless and there are no springs or friction pivots to be variables or to get dirty. If the disclosed invention gets dirty, it can be washed with water in a sink and put back into service. If for some reason there is failure of the balls, valid coins can still be pushed by the balls and the customer gets a product and no money is lost. If the customer puts the wrong coin in a slot, the wrong coin may still be returned.

The disclosed coin tester is usable and adaptable to a great variety of vending and coin-operated dispensing machines and does not need a source of electricity. It has been found that the disclosed tester is extremely insensitive to the velocity of a coin passing through and it is insensitive to reasonable variations in attitude; as an example, it can be tilted ten degrees in any direction and will still work satisfactorily. This coin tester is ideally suited for coin operated machines placed in offices and locations where outright robbery and theft is not usually expected.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A coin size tester comprising:

a. an elongate coin trackway defined by and having
   1. a bottom surface upon which a coin may roll;
   2. a guide extending upward of a first side of the bottom surface for maintaining a coin upright on edge upon the bottom surface;
   3. a retainer edge spaced upward from and positioned parallel to a second side of the bottom surface; and
   4. a sizing edge positioned parallel to and spaced upward a predetermined distance from the bottom surface for maintaining only a coin of at least a predetermined diameter upright on edge upon the bottom surface;

b. a journal for containing a ball and having
   1. a support at one end for positioning of a ball partially within the trackway;
   2. an elongate ramp extending laterally from the trackway and upward from the support to the outside of the trackway on the guide side; and
   3. a keeper at the upper end of the ramp for containing of a ball within the journal; and c. a ball contained within the journal and having
   1. a normal position resting against the support and projecting at least partially into the trackway from the guide side for biasing a coin against the retainer and sizer edges and obstructing free passage of a coin through the trackway;
   2. an alternate position retracted into the journal for opening the trackway for passage of a coin; and
   3. free movement upon the ramp between the normal and alternate positions, the ball being movable to the alternate position by a coin of at least the predetermined diameter passing through the trackway and returnalbe to the normal position after passage of such coin.

2. A coin tester according to claim 1, in which the ball is of metal.

3. A coin tester according to claim 1, in which the diameter of the ball is greater than twice the width between the guide and the retainer and sizing edges of the trackway.

4. A coin tester according to claim 1, in which the ball projects into the trackway at least the width between the guide and the retainer and sizing edges.

5. A coin tester according to claim 1, in which the ball projects into the trackway an amount in the range of 20 to 45 percent of the ball diameter.

6. A coin tester according to claim 1, in which the ball is returnable to the normal position by the force of gravity.

7. A coin tester according to calim 1, in which the ball projects into the trackway at a level between the levels of the retainer edge and the sizer edge.

8. A coin tester according to claim 1, in which the ball projects into the trackway bottom surface.

9. A coin tester according to claim 1, in which the retainer edge has a surface sloped outward and downward from the trackway.

10. A coin tester according to claim 1, in which the retainer edge has an outer surface sloping downward away from the trackway to a floor for a tested and rejected coin.

11. A coin tester accoridng to claim 1, in which the ramp extends upwardly at an angle in the range of 10 to 35 degrees.

12. A coin tester according to claim 1, in which the journal is positioned perpendicular to the trackway.

13. A coin tester according to claim 1, in which the journal includes a cam surface against which the ball is driven upon passage of a coin past the ball.

14. A coin tester according to claim 1, in which the journal has a rounded lower surface of greater radius than the ball.

15. A coin tester according to claim 1, in which the journal extends below the trackway.

16. A coin tester according to claim 1, in which the journal ball support is a concave spherical pocket.

17. A coin tester according to claim 1, in which there is a drain outlet from the support.

18. a coin tester according to claim 1, in which the ball projects into the trackway against one of the edges.

19. A coin tester according to claim 18, in which the ball projects against the retainer edge.

20. A coin tester according to claim 1, in which the trackway includes an upper surface above and spaced from the bottom surface, there being a spacing between the upper surface and the retainer edge of approximately the same as the spacing between the bottom surface and the sizing edge.

21. A coin tester according to claim 20, in which the same spacings are positioned along the trackway at the same location as the ball.

22. A coin tester according to claim 20, in which the spacing between the upper surface and the retainer edge becomes greater than the spacing between the sizing edge and the bottom surface in at least one direction along the trackway from the ball.

23. A coin tester according to claim 1, in which the trackway is formed of an extrusion and the journal is a round bore in the extrusion, the journal being positioned laterally to the direction of extrusion.

24. A coin tester according to claim 23, in which the round bore has a step extending into the bore and forming the support.

25. A coin tester according to claim 23, in which the keeper is a portion of the extrusion which is deformed and projecting into the bore.

26. A coin tester according to claim 1, in which a portion of one of the edges forms at least part of the ball support.

27. A coin tester according to claim 26, in which the portion of the one edge and a portion of the guide retain the ball in the journal.

28. A coin tester according to claim 26, in which the one edge is the retainer edge.

29. A coin tester according to claim 1, including a barrier positioned between the retainer and sizer edges for directing a coin less than the predetermined diameter out of the trackway.

30. A coin tester according to claim 29, in which the barrier has a surface tapered outward along the length of the trackway.

31. A coin tester according to claim 1, including a floor to the outside of the trackway for receiving any coin less than the predetermined diameter, the ball being positioned adjacent the trackway bottom surface.

32. A coin tester according to claim 31, in which the retainer edge has an outer surface tapering outward and downward to the floor.

33. A coin tester according to claim 1, in which the trackway is formed of separate top and bottom parts, the top and bottom parts being joined together at the level of the journal, the ball being retained in the journal jointly by the two parts.

34. A coin tester according to claim 33, in which the ball is retained in the journal between one of the edges on one part and the guide on the other part.

35. A coin tester according to claim 34 in which the ball is retained by the retainer edge.

36. A coin tester according to claim 33, in which there is a second coin trackway having a bottom surface formed by an upward facing surface of the bottom part at the level of the journal.

37. A coin tester according to claim 36, in which the upward facing surface has an opening forming part of the journal and part of the second trackway bottom surface.

38. A coin tester according to claim 1, in which there is a pair of such trackways, journals and balls, and the guide sides face one another and the journals and balls are positioned between the trackways.

39. A coin tester according to claim 38, in which the keeper for one of the balls is part of the guide in the trackway of the other ball.

40. A coin tester according to claim 38, in which the two balls are physically identical and also interchangeable between respective journals.

41. A coin tester according to claim 38 in which the journals and balls are spaced from one another along the length of the trackways.

42. A coin tester according to claim 41, in which the trackways are sized one for a relatively larger diameter coin and one for a relatively smaller diameter coin, the journal and ball for the smaller coin trackway being mounted ahead of the larger coin journal and ball.

43. A coin tester according to claim 41, in which the trackways are of the same length and are disposed side by side, one journal being spaced a given distance from a one trackway end, the other journal being spaced the same given distance from the other trackway end.

44. A coin tester according to claim 41, in which both journals have a ramp extending upwardly at a same angle.

45. A coin tester according to claim 41, in which each journal has a support spaced a given and same distance from the opposite trackway.

46. A coin tester according to claim 38, including a third coin trackway positioned between the pair of trackways and atop the pair of journals.

47. A coin tester according to claim 46, in which the journals are open to the third trackway.

48. A coin tester according to claim 46, in which the journals are positioned adjacent to the respective bottom surfaces of the pair of trackways.

49. A coin tester according to claim 48, in which the third trackway is sized for a smaller coin than either of the pair of trackways.

* * * * *